United States Patent [19]

Corlew

[11] Patent Number: 4,796,312

[45] Date of Patent: Jan. 10, 1989

[54] BATHTUB WITH ACCESS DOOR IN THE SIDE THEREOF

[76] Inventor: Fred J. Corlew, 615 W. 48th St., Box 507, Ashtabula, Ohio 44004

[21] Appl. No.: 845,265

[22] PCT Filed: Jul. 13, 1984

[86] PCT No.: PCT/US84/01092

§ 371 Date: Mar. 10, 1986

§ 102(e) Date: Mar. 10, 1986

[87] PCT Pub. No.: WO86/00510

PCT Pub. Date: Jan. 30, 1986

[51] Int. Cl.[4] ..... A47K 3/02

[52] U.S. Cl. ..... 4/555; 4/556; 4/584

[58] Field of Search ..... 4/556, 555, 584; 220/240, 344, 378; 292/177, 69, 66

[56] References Cited

U.S. PATENT DOCUMENTS

| | | | |
|---|---|---|---|
| 1,198,509 | 9/1916 | Anderson | 292/179 |
| 1,298,861 | 4/1919 | Babbitt | 292/177 |
| 2,443,751 | 6/1948 | Terepin et al. | 220/378 X |
| 3,022,550 | 2/1962 | Beckett et al. | 220/344 X |
| 3,267,614 | 8/1966 | Cazalis et al. | 220/378 X |
| 3,371,354 | 5/1968 | Hayslett | 4/556 |
| 3,423,769 | 1/1969 | Cowley | 4/556 |
| 3,578,369 | 5/1971 | Coopersmith | 292/66 X |
| 3,626,507 | 12/1971 | Hawkins | 292/177 X |
| 3,863,275 | 2/1975 | Brendgord et al. | 4/556 |
| 4,005,886 | 2/1977 | Lirette | 292/66 X |
| 4,099,753 | 7/1978 | Gwozda et al. | 292/177 |
| 4,399,569 | 8/1983 | Houle | 4/556 X |

FOREIGN PATENT DOCUMENTS

| | | | |
|---|---|---|---|
| 2032870 | 1/1971 | Fed. Rep. of Germany | 4/556 |

*Primary Examiner*—Henry J. Recla
*Assistant Examiner*—Ernest G. Cusick
*Attorney, Agent, or Firm*—D. Peter Hochberg; Mark M. Kusner; Louis J. Weisz

[57] ABSTRACT

A bath tub (13) having side walls (15, 16), a rear wall (14), an entrance and a door (20) for closing the entrance, the entrance having a seal (39) engageable with a chamfered inner surface (41) of the door when the door is closed and water pressure is exerted on the seal for sealing the interface of the seal (39) and the chamfered surface (41) against the flow of water.

17 Claims, 4 Drawing Sheets

BATHTUB WITH ACCESS DOOR IN THE SIDE THEREOF

BACKGROUND OF THE INVENTION

This invention relates to bathing apparatus, and in particular to bathing apparatus for persons who have difficulty in climbing into and/or standing in conventional bath tubs and showers. The invention further relates to the seals for the doors of bathing apparatus.

Conventional bath tubs comprise a base surrounded by an upstanding wall. In order to enter such tubs, the user must climb over the wall. This can present great difficulty or prove impossible to persons with physical infirmities caused by age, disease, injury and the like. In order to bathe in such a tub, the user must drop to a seated position on the base of the tub, which again is difficult or impossible for some persons who are disabled for some reason. Furthermore, many disabled persons are unable to stand erect to take showers in conventional bath tubs or in various types of shower stalls. Since the act of cleaning oneself is considered by most people to be a very private affair, the need of assistance of another person by individuals unable to use existing bath tubs and shower stalls can be a very degrading and embarassing experience by persons who are infirm for one reason or another, as well as causing considerable discomfort to such persons even if they can use existing bathing apparatus by themselves. Moreover, for such persons who for one reason or another must use such bathing apparatus in the presence of others, the lack of privacy can be a very unpleasant experience.

In view of the foregoing shortcomings of conventional bath tubs and shower stalls to infirm persons, various alternate proposals have been made which involve the provision of bath tubs having entrance doors in a vertical wall thereof. Such proposals have been made in U.S. Pat. Nos. 746,389, 746,390, 2,068,457, 2,075,933, 2,456,275, 2,569,825, 2,570,053, 2,714,725, 2,804,629, 2,991,482, 3,066,316, 3,371,354, 3,380,078, 3,416,166, 3,423,769, 3,703,733, 3,719,960 and 3,863,275.

Perhaps the most significant shortcoming of known tubs and stalls for the infirm is the lack of an effective seal for preventing the leakage of water from the unit during use. The seriousness of this problem is reflected in the device disclosed in U.S. Pat. No. 3,863,275, where resort was made to a pneumatic construction to alleviate the leakage problem. The inconvenience and complexity of that construction is a major disadvantage of that device.

SUMMARY OF THE INVENTION

An object of the invention is to provide an improved bath apparatus for infirm persons.

Another object is to provide a compact bath apparatus which can be entered without having to climb over a wall.

A further object is to provide a portable bath apparatus for infirm persons which can be used in private homes or institutions in an easy and effective manner.

Yet another object of the invention is the provision of a bathtub having a vertical entrance door, and an effective water seal for preventing leakage of water from the tub.

It is still another object to provide a bath tub for infirm persons having an effective and efficient drainage system.

Another object is to provide a bath apparatus for infirm persons which can be used in privacy by such persons.

It is another object to provide a bath tub for infirm persons which can be used in comfort and with ease.

A general object of the invention is to provide an improved bathing apparatus which can be used by infirm persons, which is economical and practicable to manufacture, and effective in use. Other objects will be apparent from the description to follow and from the appended claims.

The present invention in its preferred form comprises a bath tub having a vertical wall structure with an opening in which is received a hinged door. The inner face of the door has a rearwardly facing peripheral portion with a chamfered surface which is inclined towards a central recessed portion of the door. The tub has an opening about which are three forwardly facing surfaces against which the rearward peripheral portion abuts when the door is closed. A resilient gasket is disposed on the door, and is dimensioned to be pressed against the inclined surface of the door to effect a watertight seal under the pressure applied by water in the tub. The preferred tub includes an integral seat facing the door, and a foot support can be provided on the lower inner wall of door. A faucet and operating handles are preferably disposed on an inner side wall of the tub within easy reach of the user. A shower head with its own operating controls is similarly situated. A drain is preferably located on lowest part of the tub's interior, and all surfaces on the interior are advantageously so inclined as to effect the flow of water towards the drain. A curtain assembly comprising support structure and a curtain are preferably located on the upper wall sections of the vertical wall structure for providing privacy to the user. Provision is preferably made for a soap dish, water temperature gauge and the like within easy access or sight of the user. The interior is preferably formed as an integral unit to minimize the presence of any seams and to avoid crevices in which dirt, soap or the like could collect.

DETAILED DESCRIPTION OF THE PREFERRED EMBODIMENT

Figure 2:
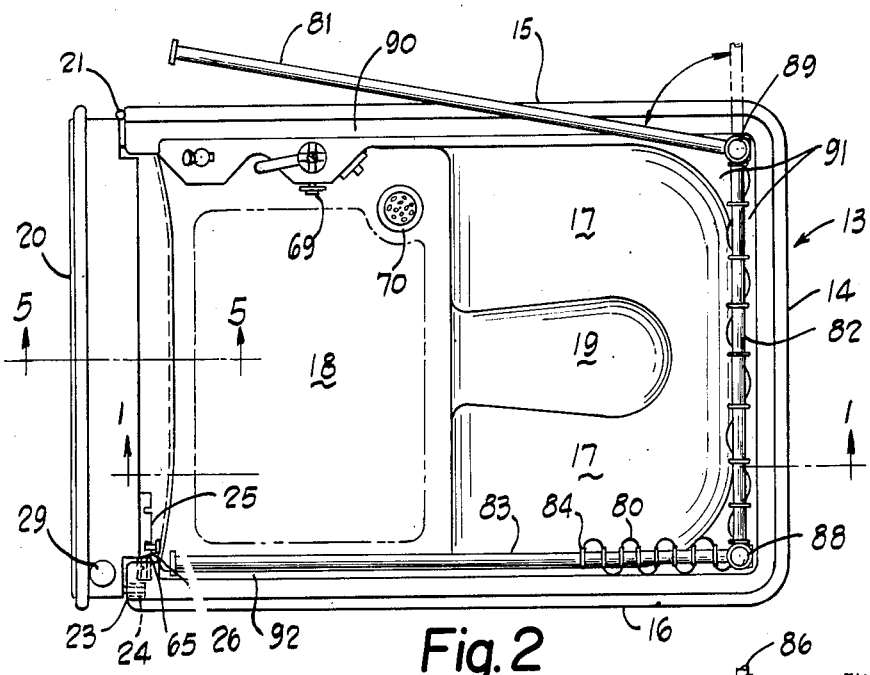
FIG. 2 is a top view of the structure according to the preferred embodiment of the invention.

Referring to the drawings, a bath apparatus according to the preferred embodiment of the invention is shown generally at 13. The apparatus includes a rear wall 14, a right side wall 15, a left side wall 16, a seat 17, a bottom 18 and a door 20 (the directions are taken through the eyes of a person seated on seat 17 and facing door 20.) The body of apparatus 13 defining the exposed exterior surfaces and interior surfaces (e.g. walls 14–16, seat 17 and bottom 18) is of unitary construction, preferably molded from a rigid, smooth material such as fiberglass reinforced plastic. Seat 17 is contoured to the anatomy of a seated person for the user's comfort, and a recessed center 19 is provided to allow water contact with the user when the apparatus is used as a sitz bath. Recess 19 also enables the water to reach more of an invalid's body.

Figure 12:
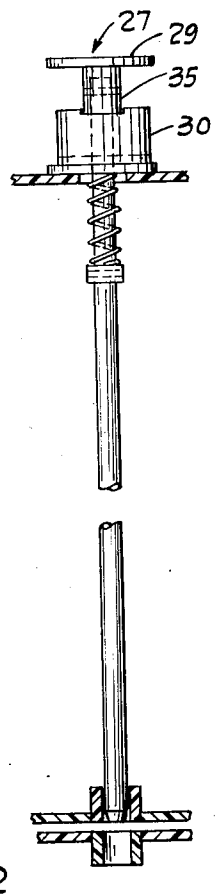
FIG. 12 is an enlarged sectional view taken on line 12—12 of FIG. 11.
Figure 11:
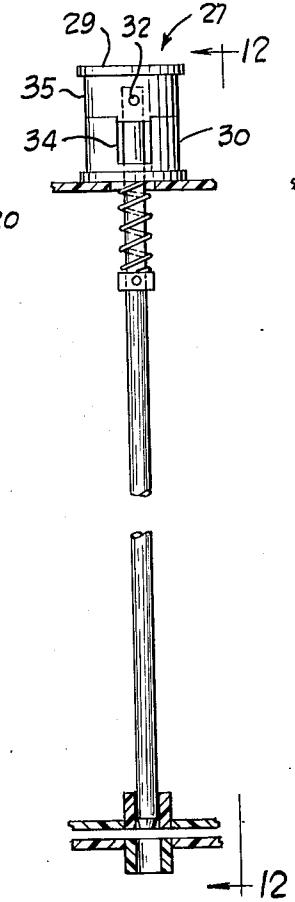
FIG. 11 is an enlarged sectional view of the vertical door lock assembly from FIG. 9 in the unlocked position.
Figure 10:
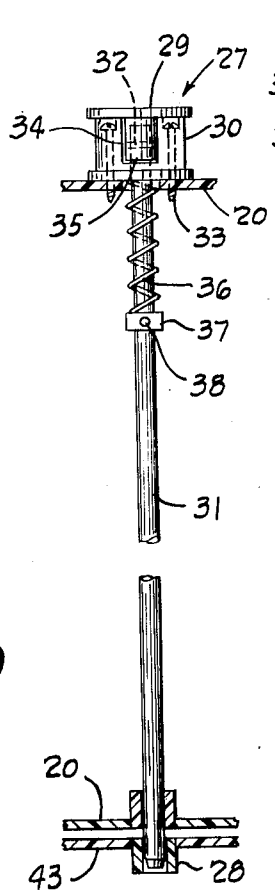
FIG. 10 is an enlarged cross sectional view of the vertical door lock assembly from FIG. 9 in a locked position.
Figure 9:
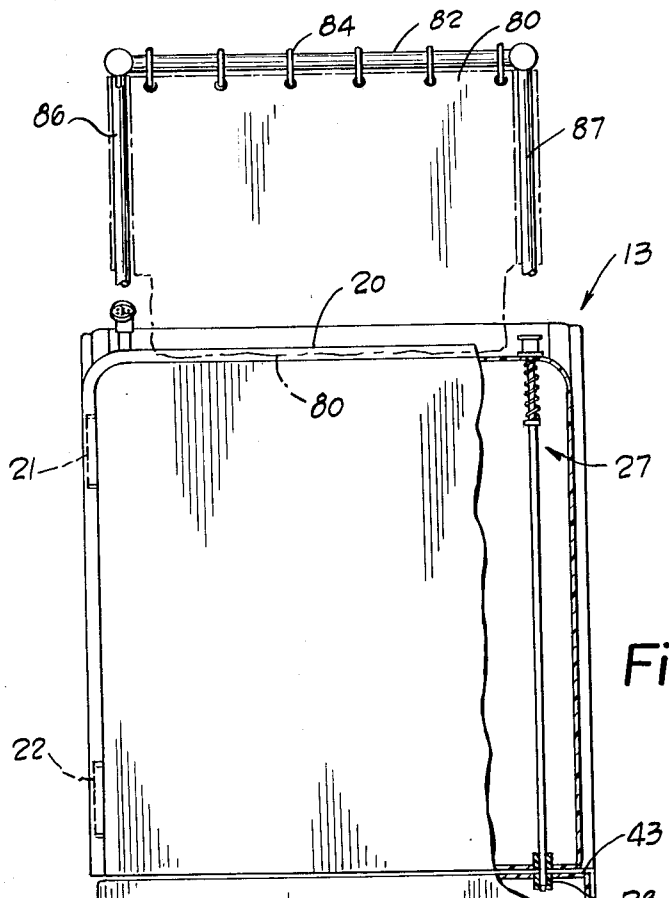
FIG. 9 is a front view taken on line 9—9 of FIG. 4.

Door 20 which is described in further detail below, is also molded from fiberglass reinforced plastic, and its exterior surfaces are defined by an integral body. An upper hinge 21 and a lower hinge 22 are attached to the forward portion of right side wall 15 and to the inner wall or proximal side portion of door 20 (FIG. 7) in a conventional manner, to support door 20 for rotation between open and closed positions. A tapered guide pin 23 is fixed in door 20 and extends rearwardly, to cooperate with a bushing 24 in side wall 16 to guide door 20 into its closed position as the door is closed. As explained below, the proper registration of the door with the door opening in the body of the unit is important for establishing a water seal. A conventional sliding bolt assembly 25 is attached to the upper inner portion of door 20 near the free vertical end portion thereof as shown clearly in FIGS. 2 and 7, so that the user of the tub can lock the door at its upper unhinged corner from the inside. The bolt of the lock is engageable with a cooperating bushing 26 in side wall 16 to lock the door. In addition, a vertical lock bolt assembly 27 is provided for both locking the door at its lower unhinged end, and for serving as a handle for opening and closing door 20. The locking of the door at its unhinged corners at the distal side of the door coupled with the hinging of the door at its other or proximal side is particularly effective in enabling the door to withstand the water pressure which develops as the water level in the tub rises. Referring to FIGS. 7 and 10–12, vertical lock bolt assembly 27 includes a top section or knob 29 mounted on a generally cylindrical base section 30 having a slot 34, knob 29 being fixed to a vertically movable locking rod 31 by means of a pin 32 which extends through aligned bores in knob 29 and rod 31. Base section 30 is fixed to door 20 by means of a set of screws 33. A vertical slot 34 is provided in base section 30 for receiving a downward, generally prismatic downward extension 35 of knob 29 when assembly 27 is in its locked condition as shown in FIG. 10. Vertical locking rod 31 extends through door 20, and it is movable by means of knob 29 between a lower locked position in which rod 31 is received in a bushing 28 in a sill of the tub assembly (described below) as shown in FIG. 10, and a raised unlocked position in which rod 31 is not in bushing 28 as shown in FIGS. 11 and 12. A biassing means in the form of a coil spring 36 is confined about rod 31 between base 30 and a collar 37 pinned to rod 31 by means of pin 38. Spring 36 provides a continuous bias on rod 31 towards the downward, locked position In order to disengage rod 31 from its locked position in bushing 28, the user raises knob 29 and thus pulls rod 31 upwardly against the bias of spring 36 to raise extension 35 from slot 34, and then rotates knob 29 by 90°, to cause the downward extension 35 of section 29 to rest on the upper surface 38 of base 30. Depressions in upper surface 38 of base 30 engage extension 35 to retain it in the rotated position. Likewise, in order to lock the door, the user rotates knob 29 by 90° to align extension 35 with slot 34, and spring 36 pulls extension 35 into the slot and rod 31 downwardly until the bottom part of rod 31 enters bushing 28.

Figure 6:
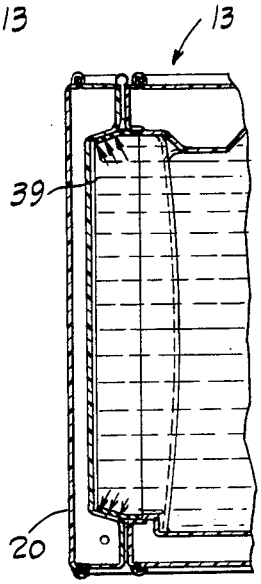
FIG. 6 is a cross sectional view taken on line 6—6 of FIG. 1.
Figure 7:
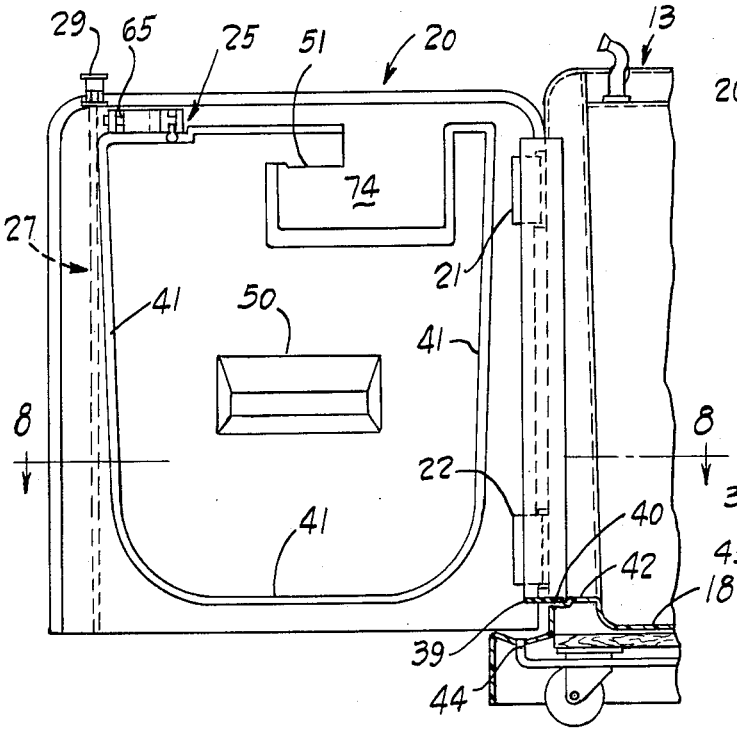
FIG. 7 is a cross sectional view, the same as FIG. 5 except with the door in the open position.
Figure 5:
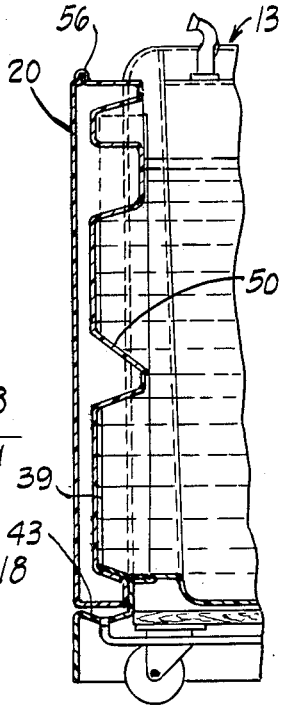
FIG. 5 is a partial cross sectional view taken on line 5—5 of FIG. 2.

An important part of the present invention is the means by which an effective water seal is provided at the juncture of door 20 and the body of the tub. Referring particularly to FIGS. 5–8, a seal or gasket 39, made of an appropriate elastic material such as natural rubber, is attached to attachment surfaces in the form of the three surfaces (collectively identified by the numeral 40) defining part of the entrance to tub 13, by means of a known waterproof adhesive. Gasket 39 extends forwardly beyond the surfaces to which it is attached, and is positioned to slide onto an engagement surface in the form of a chamfered surface 41 on the inner portion of the door 20 as shown in FIGS. 5–7. When door 20 is closed and locked, gasket 39 rests on chamfered surface 41. The amount of inclination of surface 41 is selected so that it deforms gasket 39 sufficiently to cause the gasket to engage surface 41 with a positive pressure while lying flat on surface 41 without any kinks in the gasket. A 15° angle of inclination has been found to be effective where a gasket with a $\frac{1}{8}$ inch thickness and a $2\frac{1}{2}$ inch width is employed for engaging surface 41 over $1\frac{1}{4}$ inches of its width. When the water is turned on as described below and fills the tub, the water pressure presses the gasket against the chamfered edge and makes a simple but effective water seal. This is accomplished as shown in FIGS. 5 and 6 without resort to any clamping force as in a compression gasket arrangement, and without resort to any complex pneumatic system as discussed earlier.

Figure 1:
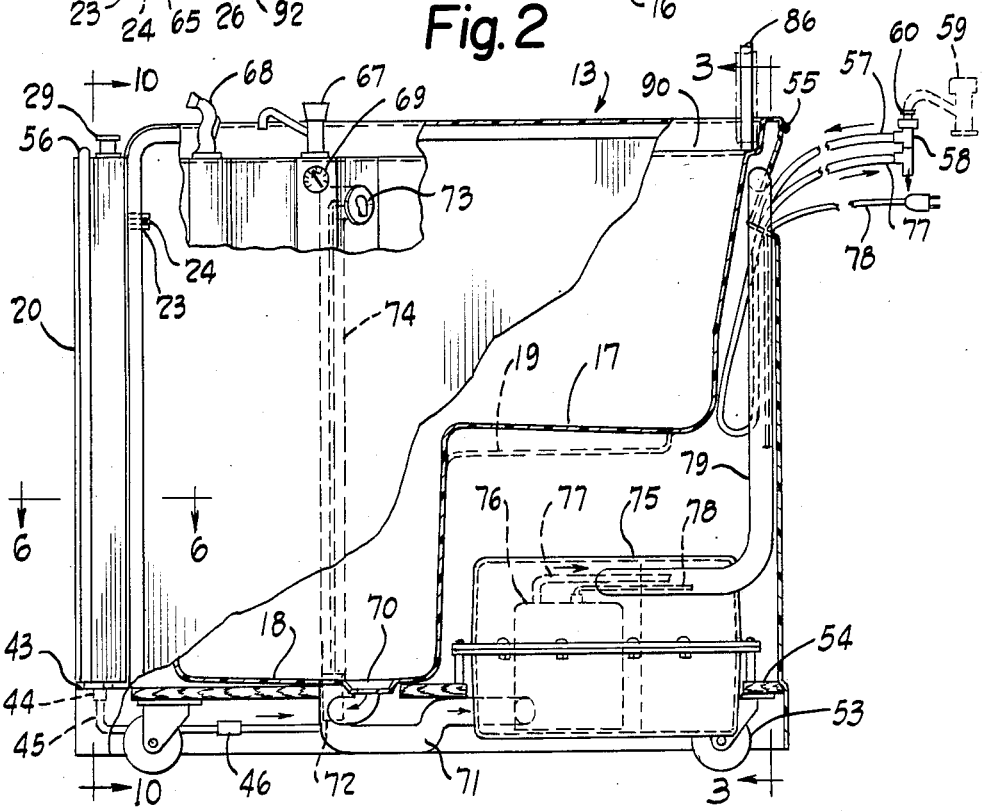
FIG. 1 is a partially cross sectioned left side view (bather's left) of the structure according to the preferred embodiment of the invention, the partial cross sections being taken on line 1—1 of FIG. 2.

A curb 42 is provided at the forward portion of bottom 18 as shown in FIG. 7, against which door 20 closes. This curb has gasket 39 attached thereto as discussed above, and further acts as a dam to prevent the residue of water from leaking out if door 20 is opened prematurely after water has been admitted into the tub, or in case the water has been turned on before the door is closed. Referring to FIGS. 1 and 7, a sill 43 is provided which extends forwardly from the base of curb 42, and this sill slopes towards a perforated drain fitting 44 which is connected to a drain hose 45. (Bushing 28 is located in sill 43 as indicated previously). Hose 45 extends to check valve 46, and then to a drain pipe 71. Drain 71 empties into a pump chamber 75, and thus water draining from gasket 39 is directed to chamber 75.

An inclined shelf 50 is located on the lower inner face of door 20 and positioned to serve as a foot rest for a bather seated on seat 17. Shelf 50 is integral with the body of door 20, and is provided with a skid resistent surface which is preferably molded into the footrest. This device eases the washing of the bather's feet, and in many instances would add to the comfort of the bather. Still referring to FIG. 7, a soap dish 51 is also molded into the inner face of door 20, and is located to be within easy access of the bather.

A set of four casters 53 are provided for rendering the tub portable Casters 53 are screwed or bolted to a base panel 54 which provides support to the tub, and must of course be sturdy enough to support the tub filled with water and holding a bather. Base panel 54 is preferably wood, but other materials are available. The overall width of the tub, i.e. the distance between the outer surfaces of side walls 15 and 16, should be narrow enough so that the tub can be moved through normal size doorways. In order to protect the tub, and the doorways and walls near which it is moved, resilient bumper strips 55 and 56 are attached to the upper portions of walls 14, 15 and 16, and to the vertical sides and top of door 20, respectively. A set of floor locks 52 are also attached to the panel. These locks can be actuated to immobilize the tub so that it cannot be moved across a floor. The locks can be disengaged when the tub is to be transported.

Water is preferably admitted to tub 13 from a conventional sink faucet through an inlet hose 57, to whose end is attached a disconnect fitting 58 which can be attached to a standard aerator type, single outlet supply faucet 59 by means of a standard adapter fitting 60, as shown in FIG. 1. The proper adjustment of faucet 59 can be made in the usual manner to control the temperature of the water. Separate inlet hoses, with appropriate fittings, can be easily used in place of the single inlet hose when separate hot and cold water faucets are to be used to supply water to the tub. In the latter event, provision is preferably made in the tub apparatus to blend the hot and cold water by means of a mixing valve which maintains a fixed water temperature through the fill cycle. Also, an automatic shut-off should be provided in the event the water temperature rises above a pre-selected value. Inlet hose 57 is attached to a faucet inlet pipe 61 and to a spray head inlet hose 62 by means of a T-coupling 63 as shown most clearly in FIG. 4. An inlet faucet assembly 67 is preferably of conventional construction, and is provided on the right hand side of the tub within easy reach of the user, so that its knob can be adjusted to admit water from hose 57 into the tub. Shower head 68 has a self-contained operating button and is similarly provided within easy access of a seated bather. A thermometer 69 can be mounted near these water inlets so that the bather can read the water temperature and adjustments can be made as necessary.

Figure 3:
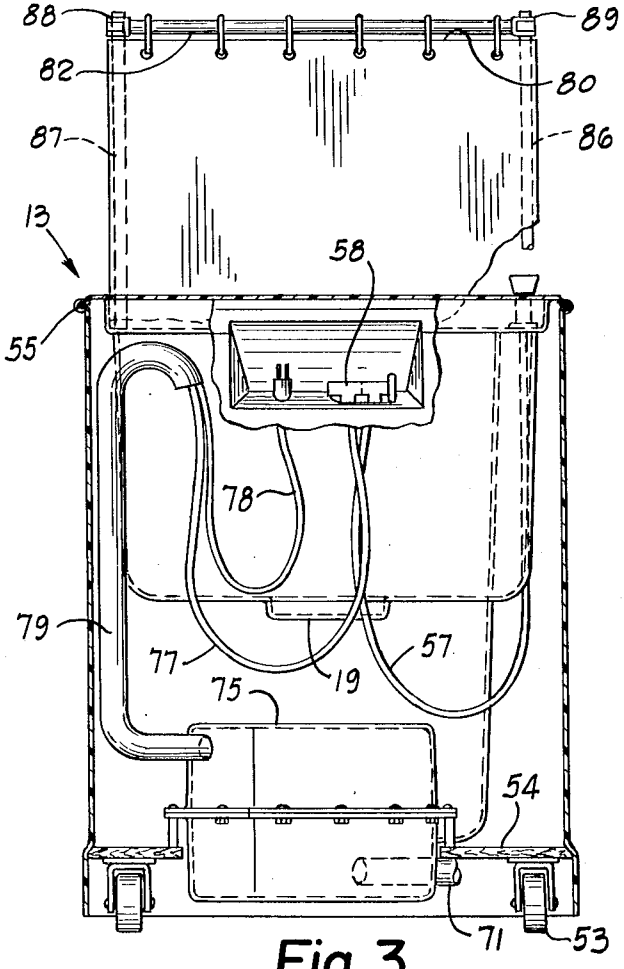
FIG. 3 is a cross sectioned view taken on line 3—3 of FIG. 1.
Figure 8:
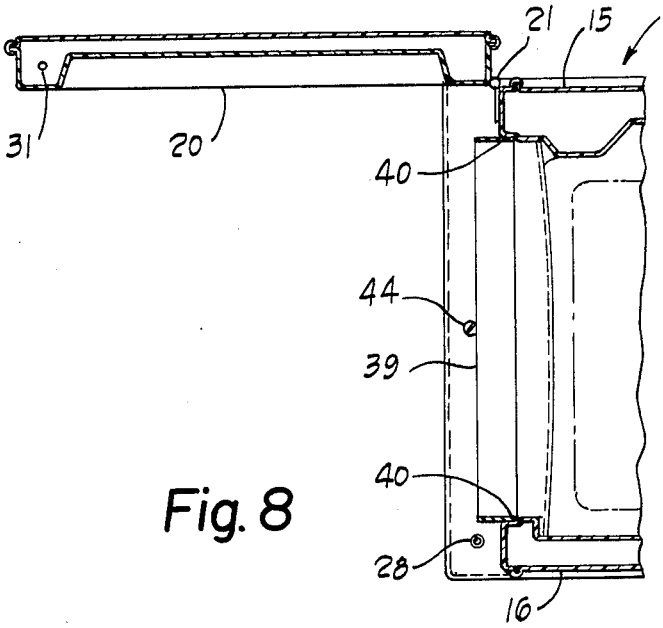
FIG. 8 is a partial cross sectional view taken on line 8—8 of FIG. 7.

Tub assembly 13 has a very effective drainage system. Bottom or floor 18 of the tub is inclined downwardly towards a floor drain 70, which leads to a drain pipe 71. A drain shut-off valve 72, controlled by a lever 73 located with easy reach of a seated bather, selectively retains or discharges water from the tub in the usual manner. An overflow pipe 74 limits the maximum depth of water in the tub by discharging water flowing into it, into the drain pipe as is known in conventional tubs and sinks. A water tight pump chamber 75 (FIGS. 1 and 3) receives drainage water. Chamber 75 is preferably constructed of molded fiberglass or other non-conductive material. An electric, submersible pump 76 of a known type having a submersible electronic float switch pumps drainage water from the tub. A pump discharge hose 77 and a power supply cord 78 for the pump pass from the pump through a hose 79 and then through rear wall 14 of the tub as shown in FIG. 3. Discharge hose 77 runs parallel to inlet hose 57 into fitting 58, and drainage water is thereby directed out of the unit into a selected, appropriate receptacle such as a sink, basin, floor drain or the like. Power cord 78 must be plugged into an electrical outlet to energize the pump.

Figure 4:
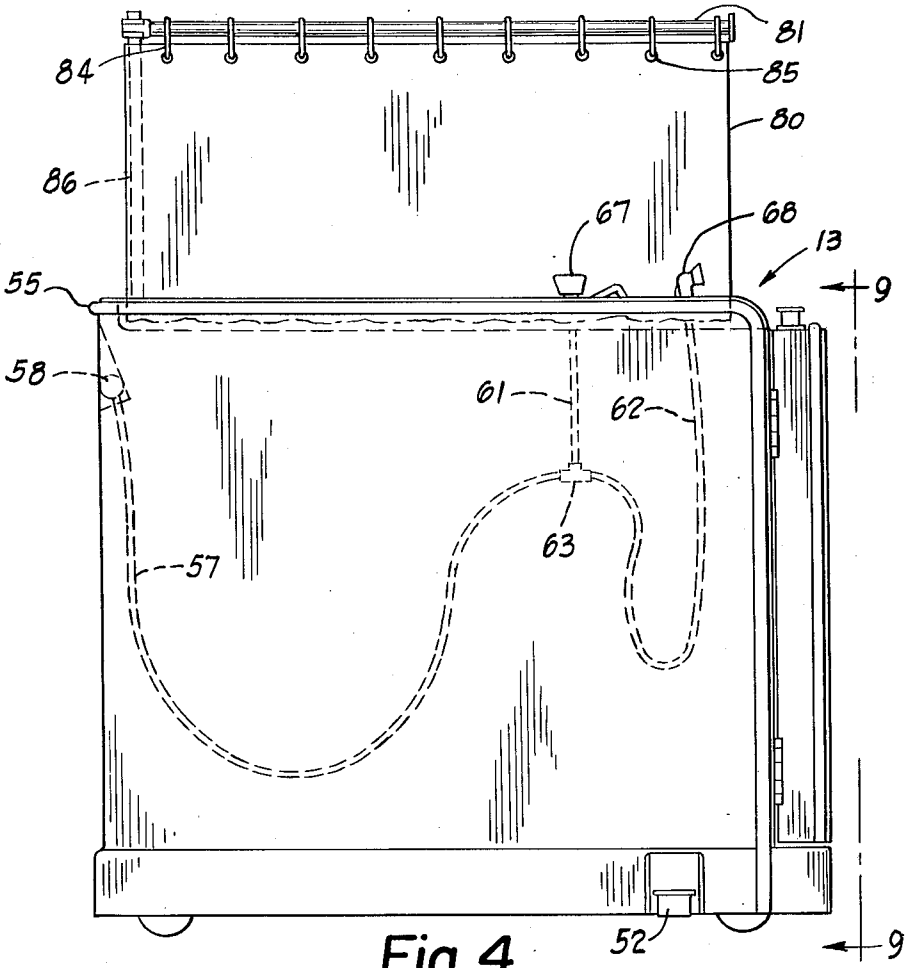
FIG. 4 is a right side view (bather's right) of the structure according to the preferred embodiment of the invention.

Referring to FIGS. 2–4, a curtain assembly is provided for the privacy of the bather. This assembly includes a waterproof curtain 80 made of an appropriate plastic or the like suspended from horizontal rods 81, 82 and 83 mounted above walls 15, 14 and 16, respectively, by means of curtain rings 84 mounted on the rods and inserted through holes (such as eyelets) 85 in the curtain. Horizontal curtain rods 81, 83 are pivotally mounted on removable vertical corner posts 86, 87 by means of hinged connectors 88, 78. Corner posts 86, 87 are received in cylindrical bores extending vertically downward at the top of the junctures of the side walls and rear wall 14. Rods 81 and 83 can be swung outwardly as shown in FIG. 2 so that an attendant can bathe a person seated in the apparatus. As shown in FIGS. 2–4, a downwardly inclined ledge is provided for receiving the bottom portion of the curtains to receive water dripping from the curtains. Thus, sidewall 15 has a ledge 90 disposed inwardly and below the outer portion of that side wall, and rear wall 14 and side wall 16 have corresponding ledges 91 and 92, and three ledges forming a continuous ledge into which water splashed against the curtain will flow into the tub.

The operation of the bathing apparatus described above is straightforward. The bather enters the unit and sits on seat 17. The bather or attendant swings door 20 shut, with guide pin 23 cooperating with bushing 24 to assure proper closing of the door. Knob 29 is then rotated 90° until extension 35 slides off upper edge 38 of base 30, thus causing vertical rod 31 to drop into bushing 28 to lock the door at its lower corner. The bather or attendant additionally operates both assembly 25 to lock the door at its upper corner. The bather or attendant then opens faucet 67 to admit water into the tub. (An attendant or the bather would previously have connected fitting 60 to exterior faucet, 59 adjusted the water temperature and opened the latter faucet.) As the water level rises, the water pressure urges seal 39 against surface 41 of door 20 to create a water tight seal around the door. The bather can monitor the water temperature by means of thermometer 69. While the tub is filling (or at any time), the bather can use shower head 68 for showering or for washing the hair. The bather can rest the feet on rest 50, and the soap dish is in easy reach in dish 51. When the water has reached the desired level, the bather closes faucet 67, and proceeds to bathe or be bathed. Upon conclusion of the bath, lever 73 is actuated to open drain shut-off valve 70, and water is discharged through pipe 71 into pump chamber 75. When the water level in chamber 75 rises sufficiently, it lifts the float switch to energize pump 76. Water is then drained through hose 77 and fitting 58, and into the sink or other discharge receptacle. Water also enters hose 79, but it cannot overflow because its high point is above the inlet to overflow pipe 74. Hose 79 serves to vent pump chamber 75 to the atmosphere. When the tub is completely drained, the float switch falls to its lower level and turns off pump 76. The bather then unlocks lock assembly 25 and lifts and turns knob 29 to raise rod 31 to its unlocked condition. Door 20 can now be opened and the bather can leave the tub.

The invention can incorporate other useful accessories in addition to those referred to above. For instance a whirlpool unit could be mounted on the top of the door to extend into the chamber of the tub for imparting whirlpool action to water in the tub.

The preferred embodiment of the invention described above is a very effective and useful device. The bath assembly is compact and attractive, and it can be used easily while avoiding water leakage in a simple and effective manner. The device can be moved from location to location without undue effort. It affords the user privacy and dignity while bathing. The device can be constructed using many commercially available components and with conventional manufacturing techniques.

The embodiment described above was a portable unit. However, the invention further contemplates a fixed unit which could be a permanent installation in home or institution. In such a permanent installation, most of the plumbing components could be located externally of the tub assembly itself, and the tub could be installed in the manner of a conventional bath tub, therapeutic whirlpool device or the like.

The invention has been described in detail with particular emphasis on the preferred embodiment, but it should be understood that modifications and variations within the spirit and scope of the invention may occur to those skilled in the art to which the invention pertains.

I claim:

1. A bathtub comprising: a body portion, said body portion including:

a horizontal base opposing, parallel vertical first and second walls on opposite sides of said base;

a vertical third wall interconnecting said first and second walls and said base; and an entrance to said bathtub opposite said third wall, said entrance including opposing, vertical side edges and a horizontal base edge extending between said side edges;

a door for closing said entrance, one of said door and said entrance having an attachment surface and the other of said door and said entrance having an engagement surface wherein said door includes a central recessed portion, said attachment surface is disposed on said side edges and said base edge of said entrance, and said engagement surface is on said door projecting outwardly from said central recessed portion, said engagement surface being chamfered toward said central recessed portion;

hinge means for mounting said door on said body portion for pivotal movement between open and closed positions about an axis along one of the edges of said entrance; and a single sealing means for sealing the interface of said door and said edges against the flow of water when the door is in the closed position, said sealing means including an elastic, elongated generally flat sealing member having an attachment edge portion and free edge portion, said attachment edge portion being attached to said attachment surface;

said free edge portion engaging said engagement surface to form the sole seal at the interface of said door and said edges against the flow of water when said door is in the closed position and the bathtub is filled with sufficient water to exert water pressure on said sealing member.

2. The invention according to claim 1 wherein said base, walls and entrance are an integral unit.

3. The invention according to claim 2 wherein said integral unit is made of molded fiberglass reinforced plastic.

4. The invention according to claim 1 wherein said first and second walls are side walls and said body portion further includes a seat adjacent said third wall opposite said entrance.

5. The invention according to claim 4 and further including a foot rest on said door disposed opposite said seat when said door is in the closed position.

6. The invention according to claim 4 wherein said seat includes a raised upper peripheral portion and a recessed upper central portion.

7. The invention according to claim 1 and further including a drain in said base.

8. The invention according to claim 1 wherein said door is made of molded fiberglass reinforced plastic.

9. The invention according to claim 1 wherein said hinge means is mounted on said door for pivotal movement about one of said vertical side edges of said entrance.

10. The invention according to claim 9 and further including a vertical locking rod, and a first receptacle in said door for receiving said locking rod and a second receptacle in said body portion aligned with said first receptacle when said door is in the closed position for receiving said locking rod, said locking rod being movable between a raised position out of said second receptacle for unlocking said door and a lowered position wherein said locking rod is received in both of said receptacles for releasably locking said door in the closed position.

11. The invention according to claim 10 and further including biassing means for biassing said locking rod to the lowered position.

12. The invention according to claim 10 and further including means for releasably retaining said locking rod in the raised position.

13. The invention according to claim 10 wherein said vertical locking rod and said first receptacle are located in said door opposite said one vertical edge about which said door pivots and further including second locking means for locking the upper portion of said door to the edge of said entrance opposite said one vertical edge, to cooperate with said locking rod to lock the upper and lower portions of said door to the edge of the entrance opposite said one vertical edge.

14. The invention according to claim 1 and further including an upper ledge on the upper parts of said side walls and said third wall, and a curtain assembly mounted on said body portion, said curtain assembly including a curtain extending from a position above said ledge to a position at or below said ledge.

15. The invention according to claim 14 wherein said ledge is recessed into the upper parts of said side walls and said rear walls.

16. The invention according to claim 1 and further including caster means attached to said body portion for engaging the floor beneath said bathtub to enable the rolling of said bathtub on the floor.

17. The invention according to claim 1 wherein said body portion includes a forwardly facing section engageable with said door when the door is in the closed position, and one of said door and said forwardly facing section having a guide pin and the other having a guide pin receptacle, said guide pin entering said guide pin receptacle as said door moves to the closed position to guide said door into the closed position.

* * * * *